United States Patent [19]

Bienek et al.

[11] 4,437,578

[45] Mar. 20, 1984

[54] CONTAINER AND CLOSURE MEANS FOR STORAGE OF RADIOACTIVE MATERIAL

[75] Inventors: Heinz Bienek, Oberhausen; Rudolf Finkbeiner, Ratingen; Wilhelm Wick, Essen, all of Fed. Rep. of Germany

[73] Assignee: Steag Kernenergie GmbH, Essen, Fed. Rep. of Germany

[21] Appl. No.: 390,956

[22] Filed: Jun. 22, 1982

[30] Foreign Application Priority Data

Feb. 9, 1982 [DE] Fed. Rep. of Germany ... 3204300

[51] Int. Cl.[3] ..... B65D 51/18

[52] U.S. Cl. ..... 220/256; 220/288; 220/319

[58] Field of Search ..... 220/200, 256, 288, 319; 206/591, 592, 593

[56] References Cited

U.S. PATENT DOCUMENTS

| | | | |
|---|---|---|---|
| 2,919,048 | 12/1959 | Harvey | 220/256 |
| 2,920,789 | 1/1960 | Tinker | 220/256 |
| 3,620,405 | 11/1971 | Peters et al. | 220/256 |
| 4,190,160 | 2/1980 | Andersen et al. | 220/256 |

FOREIGN PATENT DOCUMENTS

| | | |
|---|---|---|
| 19544 | 11/1980 | European Pat. Off. . |
| 54944 | 6/1982 | European Pat. Off. . |
| 2738592 | 3/1979 | Fed. Rep. of Germany . |
| 2838138 | 1/1980 | Fed. Rep. of Germany . |
| 1559096 | 3/1969 | France . |
| 2477109 | 9/1981 | France . |
| 21525 | of 1913 | United Kingdom . |

OTHER PUBLICATIONS

K. Kollmann: "Konstruktionsbücher", Ban 17, Springer-Verlag, 1975 2. Auflage: K. Trutnovsky: Berührungsdichtungen an ruhenden und bewegten Maschinenteilen.

*Primary Examiner*—George T. Hall

*Attorney, Agent, or Firm*—Andrus, Sceales, Starke & Sawall

[57] ABSTRACT

In the final storage of radioactive substances in containers, these containers must be sealed so as to be gas-tight by means of a cover, before they are taken to the final storage place. In order to avoid thermal stress, which has up till now been customary, of the radioactive substances on the one hand and of the container and cover on the other hand, it is proposed that the container and the sealing cover should be suitably ground on their seating areas which cooperate with each other, and when the container is closed the cover is held by prestressing on the seating area of the container. In a preferred method, after grinding, a thin equalizing layer of a highly corrosion-resistant, deformable material is applied to at least one of the seating surfaces of the container and cover, in order to achieve a compensation for any roughness which may be present, which will improve the sealing, depending on the technically and/or economically possible extent of the grinding. It is also possible, however, to form the prestressing by means of a lapped contact.

29 Claims, 9 Drawing Figures

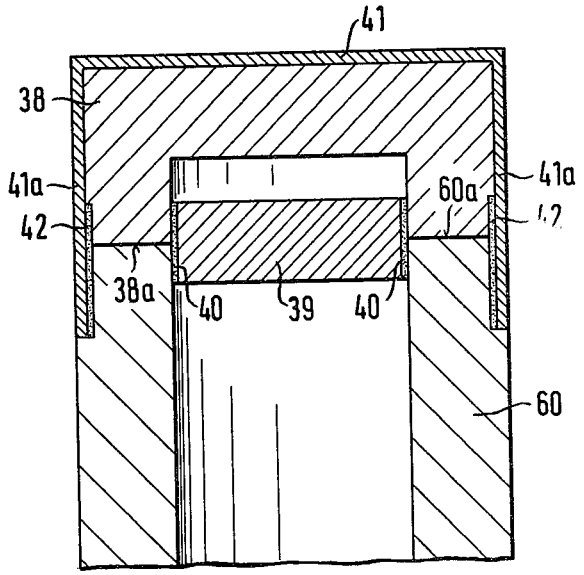
FIG. 6
FIG. 7
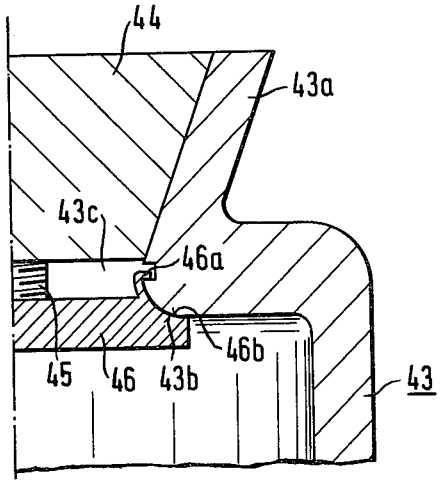

FIG. 8
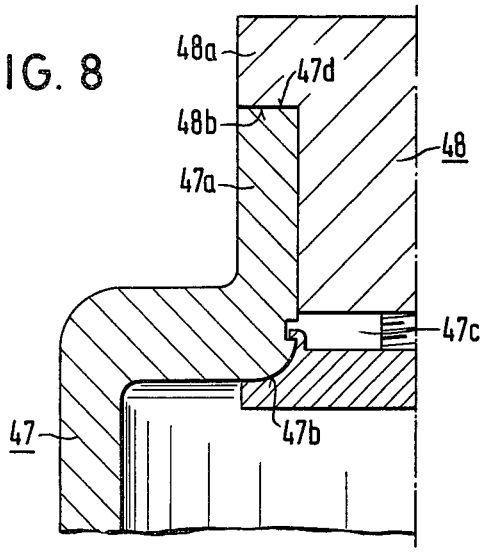
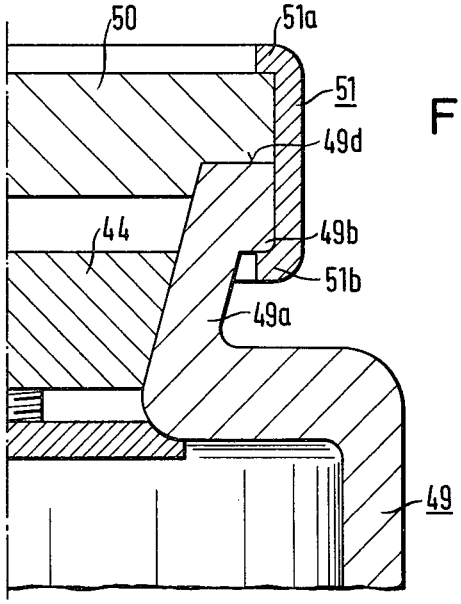
FIG. 9

CONTAINER AND CLOSURE MEANS FOR STORAGE OF RADIOACTIVE MATERIAL

BACKGROUND OF THE INVENTION

This invention relates to a method for closing with a cover a container for the final storage of radioactive substances, wherein the container and/or cover consist of a ceramic or metallic material.

Such a method is known from KfK 3000, September 1980—"Comparison of the various alternative shielding methods and evaluation of their practicability"—and Study "Alternative shielding methods", Nuclear Research Centre, Karlsruhe. In this method, an aluminium oxide container having an open edge extending at right angles to the axis of the container and a hemispherical cover of aluminium oxide are connected to each other. When the seating area of the cover is in engagement with the seating area of the container, the container and cover are secured together by the so-called "HIP Process" (Hot Isostatic Pressing). A compressing press fitted with a special furnace is necessary for this process. In order to achieve a leak-free connection between the container and cover, a temperature of around 1350° C. and a pressure of at least 70 MPa is necessary. The high temperature and high amounts of energy are not without problems for the properties of the radioactive substances packed into the container, particularly if temperature-sensitive inner containers are used. Furthermore, a low stress condition in the joint area leading to a unitary structure of the cover and container can only be achieved by precise temperature control during cooling. This process is too expensive for series packing in hot cells and is therefore uneconomic.

The object of the present invention is to produce a method for gastight sealing of the type first referred to above, which can be used with sealing temperatures which are harmless to the packed radioactive substances and to the container, and at atmospheric pressure.

SUMMARY OF THE INVENTION

This object is achieved in that the container and cover are suitably ground in their seating areas which cooperate with each other, and when the container is closed the cover is held by prestressing on the seating area of the container. By means of the grinding and the ground edges being held together by prestressing, the container is made gastight, so that after being loaded and closed it can be transported from the hot cell to the final storage place without endangering the surroundings. After storage of the closed container in the final storage place, the cover becomes loaded after a certain time with underground or rock pressure which can reach up to 300 bar, and is pressed with corresponding force on to the seating area of the cover, whereby the sealing effect is further increased.

When the container is closed, it is possible that, on application of the prestressing force, the cover is pressed from the outside against the seating area of the container, or that the cover is pulled from the inside against the seating area of the container or is acted upon by the engagement between lapped surfaces.

If the sealing effect is only to be obtained by achieving a peak-to-valley height in the seating areas which can only be produced by uneconomical methods or which cannot be obtained with the metallic or ceramic material used for the cover or container, then preferably, after the grinding, a thin equalising layer of a highly corrosion-resistant, deformable material is applied to at least one of the seating surfaces of the container and cover.

The equalising layer can be in the form of a prefabricated foil, or the layer can be applied directly to the seating area.

A highly corrosion-resistant, ductile metal can be used as the material for the layer. Preferred materials for this purpose are: titanium, platinum, gold, silver, chromium, nickel.

On the other hand, a deformable ceramic, preferably in the form of ceramic dust, can be used as the material for the layer. Graphite is preferred for this purpose, on account of its inherent antifriction properties. When using a ceramic adhesive as the material for the layer, the reliability of the closure of the container is increased.

The invention is also directed to storage devices consisting of a container for the final storage of radioactive substances and a cover for the container, whereby the container and/or cover consist of a ceramic or metallic material.

In one method of achieving this object, the storage device according to the invention is characterised in that the container and cover are suitably ground on their seating areas which are connected to each other, and a prestressing device is provided which is supported on the container in a form-locking manner and/or tensionally and which engages with the cover, this prestressing device prestressing the cover against the seating area of the container.

Another method of achieving this object is characterised in that the container and cover are suitably lapped with each other on their seating areas which cooperate with each other, in such a way that the cover is prestressed against the seating area of the container by the forces acting between the lapped surfaces.

The following ceramic materials can be used as the ceramic material for the container and cover:

$Al_2O_3$, $Al_2O_3$ compounds, such as cordierite ($2MgO.2Al_2O_3.5SiO_2$) and mullite ($3Al_2O_3.2SiO_2$), or carbon or carbon compounds, such as SiC.

In the embodiment according to the invention in which the contact areas are lapped, $Al_2O_3$ is primarily used alone or in a mixture with talc and kaolin. In a mixture of 95–100% by weight $Al_2O_3$, 0–3% by weight talc and 0–3% by weight kaolin, impermeability to water is achieved in a lapped condition if one of the seating areas has a finished lapping with an effective value of less than 10 and a plane of 3 light bands of helium light.

The following metallic materials can be used as the metallic material for the container and cover:

Cast iron with spherical graphite DIN 1693, austenitic cast iron DIN 1694, rust-proof cast steel DIN 17445 and Si-cast iron.

The cover is preferably made of the same material as the container. Furthermore, with radioactive waste with long half-life periods it is preferable that the material for the cover and container should be a ceramic material, whilst metallic materials can be used for containers which receive radioactive waste with a shorter life. Under certain circumstances it is also possible for one component of the container to be of ceramic and the other of a metallic material. When a ceramic or metallic material is used alone, it is naturally also possible for the cover to consist of a ceramic or other material differing from the container.

For the storage device, it is appropriate if the seating areas are rotational surfaces selected from straight circular surfaces connected with either conical surfaces or partly spherical surfaces.

BRIEF DESCRIPTION OF THE DRAWINGS

FIG. 6 shows a further embodiment with a cap-like sealing cover and a container, whereby the prestressing is effected by means of a lapping contact between the lapped seating areas of the cover and container, FIG. 7 shows an embodiment in which the filling opening has a smaller cross-section than the receiving area, FIG. 8 shows a further embodiment with a small filling opening, and FIG. 9 shows a third embodiment with a reduced filling opening.

DETAILED DESCRIPTION OF THE PREFERRED EMBODIMENTS

Figure 1:
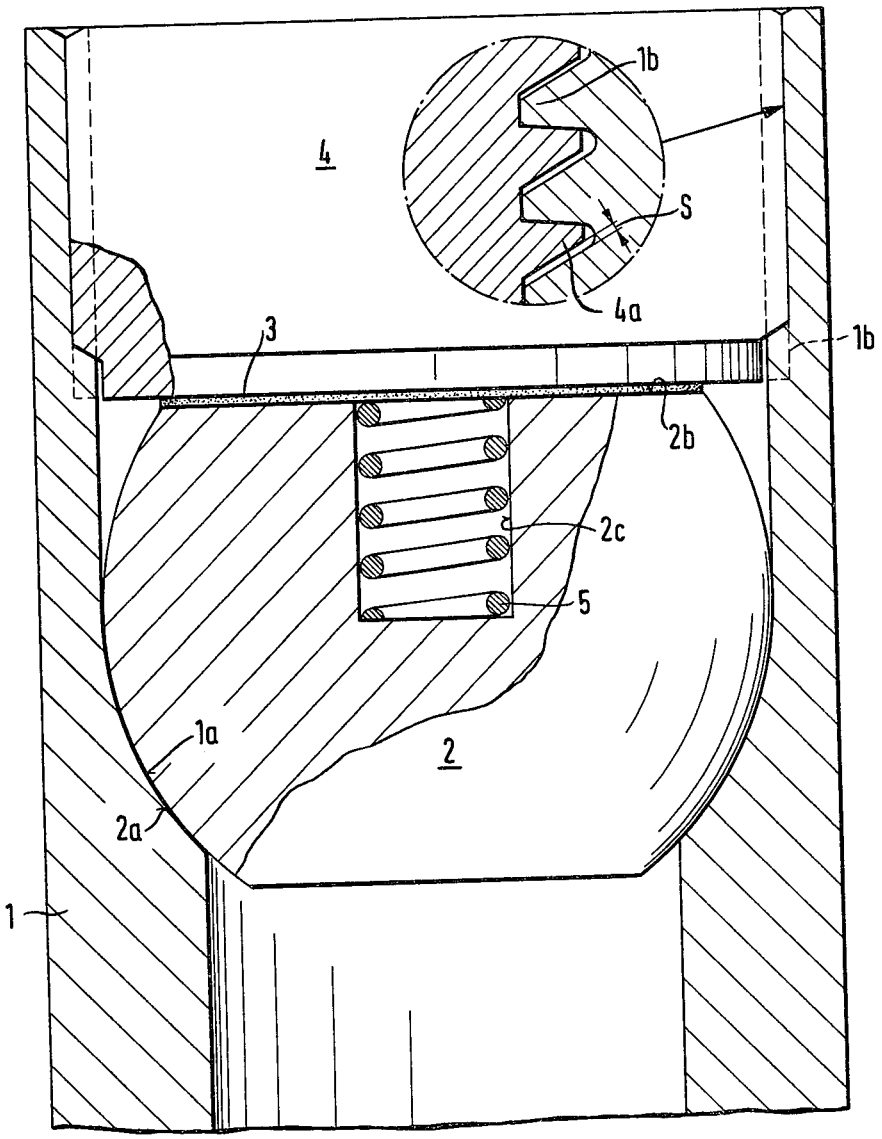
FIG. 1 shows a first embodiment of a storage device according to the invention with a spherical sealing cover and a pressure cover prestressing this from the outside.

In all the drawings the lower part of the container 1, 6, 19, 25, 43, 47, 49, 60 is not shown. The base of the container can be formed in one piece with the housing, or it can be connected with the container housing in a suitable way, for example by the HIP process, after having been produced separately. In FIG. 1, a spherical sealing surface 1*a* is ground into the container 1 near to its free opening. A spherical sealing cover 2 rests on the spherical surface 1*a*, with a corresponding ground spherical sealing surface 2*a*. The sealing surfaces 1*a* and 2*a* can, for example, be ground or lapped to a peak-to-valley height $R_t$ of 1 to 0.4 μm. If the sealing contact between the seating surfaces 1*a* and 2*a* is not sufficient at the ground peak-to-valley height, or if the achieving of such a peak-to-valley height is too uneconomic (so that the grinding process is concluded at a peak-to-valley height $R_t$ of, for example, 16 to 2.5 μm), then the previously mentioned equalising layer can be placed between the sealing surfaces. Since the thickness of the layer is too small compared to the dimensions in FIG. 1, such a layer is not shown diagrammatically in FIG. 1 or the following figures of drawings.

The partly spherical sealing cover 2 has a prestressing surface 2*b* extending essentially at right angles to the longitudinal axis of the container 1. In the embodiment shown, a thin buffer disc 3 of a ductile or flexible metal lies on the prestressing surface 2*b*, this buffer disc compensating for any unevenness in the surfaces of the cover. A pressure cover 4 with an external thread 4*a* is screwed against the buffer disc 3, this thread engaging with a corresponding internal thread 1*b* of the container. As can be seen from the detailed diagram, the external thread 4*a* and internal thread 1*b* have a clearance S between each other.

Furthermore, the sealing cover 2 is provided with a socket 2*c* for handling by an implement, in which socket a compression spring 5 can be placed after the sealing cover 2 has been placed in the container 1.

After filling the container in the hot cell, the sealing cover 2 is put in position. After the pressure spring 5 has been inserted, the pressure cover 4, to which the buffer disc 3 is preferably connected, is screwed in place until the buffer disc is uniformly compressed, and the sealing surface 2*a* is pressed with the desired initial stressing force against the sealing surface 1*a*. Simultaneously the compression spring 5 is compressed.

After storage of the closed container in the final underground storage location, the pressure cover 4 is acted upon in the axial direction by the underground pressure produced there, which, in a salt mine for example, works as hydrostatic pressure due to the salt convergence. By taking up the clearance S, the cover can be pressed into the container so that the contact pressure of the seating surface 2*a* on the seating surface 1*a*, previously produced by the prestressing, is substantially increased and the sealing action is improved. On account of the spherical formation of the sealing cover, eccentric axial stresses can also be accommodated on taking up of the clearance S by the permitted rotating or settling movements of the sealing cover 2, without the extent of the sealing contact between the two sealing surfaces, and thus the sealing action, being reduced.

Instead of the rigid buffer disc 3, a buffer layer in the form of a powder can also be placed on the prestressing surface 2*b* when the container is closed.

Figure 2:
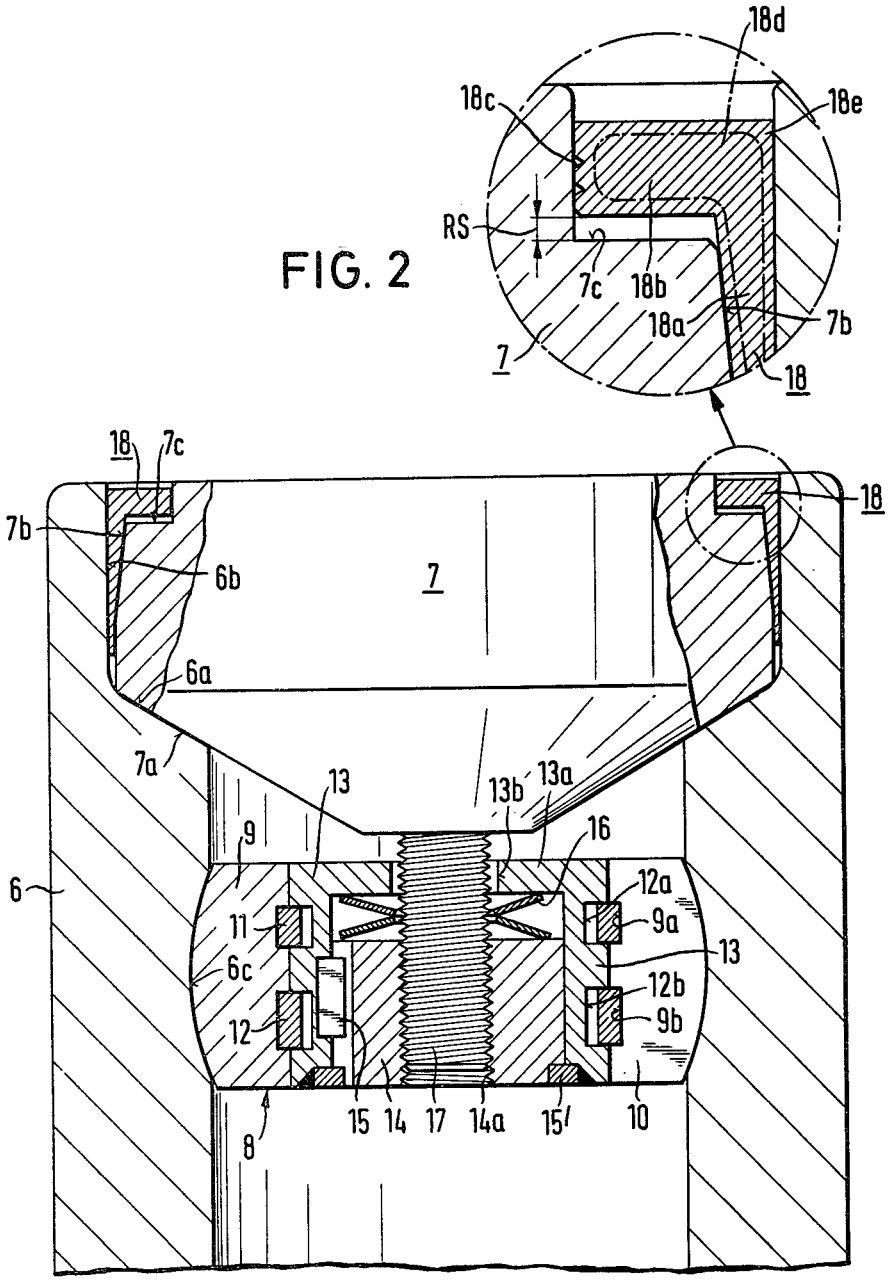
FIG. 2 shows a conical sealing cover with a prestressing device prestressing this cover from inside the container.

In the embodiment according to FIG. 2, a container 6 is provided with a conical sealing surface 6*a*. On the sealing surface 6*a* there is a sealing cover 7 with a corresponding conical sealing surface 7*a*. The observations made in the description of the first embodiment regarding the peak-to-valley height and the use of an equalising layer also apply for all the other embodiments.

Below the conical sealing surface 6*a*, the container 6 is provided with a part-spherical groove 6*c*, in which a prestressing device 8 is held. A clamping ring 9 engages into the groove 6*c*, this clamping ring being provided with a slot 10. Two annular slots 9*a* and 9*b* of different rectangular cross-sections are formed on the inner surface of the clamping ring 9. Spring washers 11 and 12 engage in the annular slots, these spring washers holding a casing section 13 provided with corresponding annular slots 12*a* and 12*b* on its outer side in the clamping ring 9. A flange 13*a* on the casing section 13 projects inwards and defines a central opening 13*b*.

Inside the casing section 13, a nut 14 with an internal thread 14*a* is held so as to be rotationally rigid by means of a key 15, but it is axially displaceable. The nut is prevented from dropping out of the casing section 13 by a retaining ring 15'. Two cup springs 16 are arranged between the front internal surface of the nut 14 and the internal annular surface of the flange 13*a*. Other forms of spring are also possible.

In the method shown in FIG. 2, the sealing cover 7 is provided with a threaded stud 17. This can be formed in one piece with the sealing cover. A paraxial straight cylindrical sealing surface 6*b* leads from the conical sealing surface 6*a* of the container 6. This sealing surface 6*b* lies opposite an inwardly sloping conical sealing surface 7*b* on the sealing cover 7. The conical sealing surface 7*b* meets a circular flanged step 7*c* opening out on to the free side of the sealing cover 7.

In the gap thus remaining between the container 6 and sealing cover 7, there is placed an annular seal 18 with an external wedge section 18*a* extending in the direction of the container axis and an annular section 18*b* extending at right-angles to the container and engaging in the flanged step 7*c*. The detailed diagram in FIG. 2 shows that the height of the annular seal 18*b* is smaller than the depth of the flanged step 7*c*, so that when the annular seal is prestressed a clearance RS remains below the seal. Furthermore, when the container is closed, the annular section 18*b* does not lie on the base of the flanged step 7*c*, but exerts a sealing action on the corresponding surface of the flanged step 7*c* with its inner annular surface which extends coaxially to the axis of the container. In this area, the annular section 18*b* is provided with recesses 18*c*, which on the one hand work as a labyrinth sealing and on the other hand prevent unacceptably high radial forces from acting on the container housing by deformation of the points of the labyrinth.

After the container 6 has been filled with radioactive material, the slotted clamping ring 9 is inserted into the container. Then the casing section 13, in which the threaded nut 14 and the set of cup springs 16 have been previously mounted, is inserted and prevented from axial displacement by means of the slotted spring washers 11 and 12. The sealing cover 7 is positioned and screwed into the nut 14 by means of the threaded stud 17. By this means, the nut 14 moves in the direction of the sealing cover 7, whereby the set of springs 16 is compressed, so that the desired minimum contact pressure is obtained between the sealing surfaces 6*a* and 7*a*. Then the annular seal 18 is placed in the gap between the sealing cover 7 and the container 6 and is compressed by means of a suitable assembly tool (punch etc.). (The sealing surfaces 6*b* and 7*b* are also preferably lapped). The wedge is compressed to such an extent that the clearance RS remains between the lower side of the annular section 18*b* and the upper side of the base of the flanged step 7*c*.

The underground pressure which forms exerts a pressure in the axial direction on the free upper surface of the annular section 18*b*, this pressure forcing the annular seal 18 down harder between the sealing surfaces 6*b* and 7*b* and thus increasing the sealing action. The extent of the compressive force, and thus the force generated radially by the wedge shape of the annular seal on the container in the area of the sealing surface 6*b*, can be regulated to a constant outer pressure by preselecting the annular surface on the outer side of the annular seal 18. The recesses 18*c* also provide the possibility of adjustment. A type of material for the annular seal 18 is chosen which guarantees that the forces can be transmitted to the wedge-shaped section 18*a* before the annular section 18*b* is deformed. For this purpose a sealing element can also be inserted which has a highly corrosion-resistant core 18*d* made of a material which is only slightly deformable, and has a jacket 18*e*, particularly in the contact area of the sealing surfaces 6*a*, 7*b* and 7*c*, consisting of a highly corrosion-resistant and ductile material (see the dotted line in FIG. 2).

Figure 3:
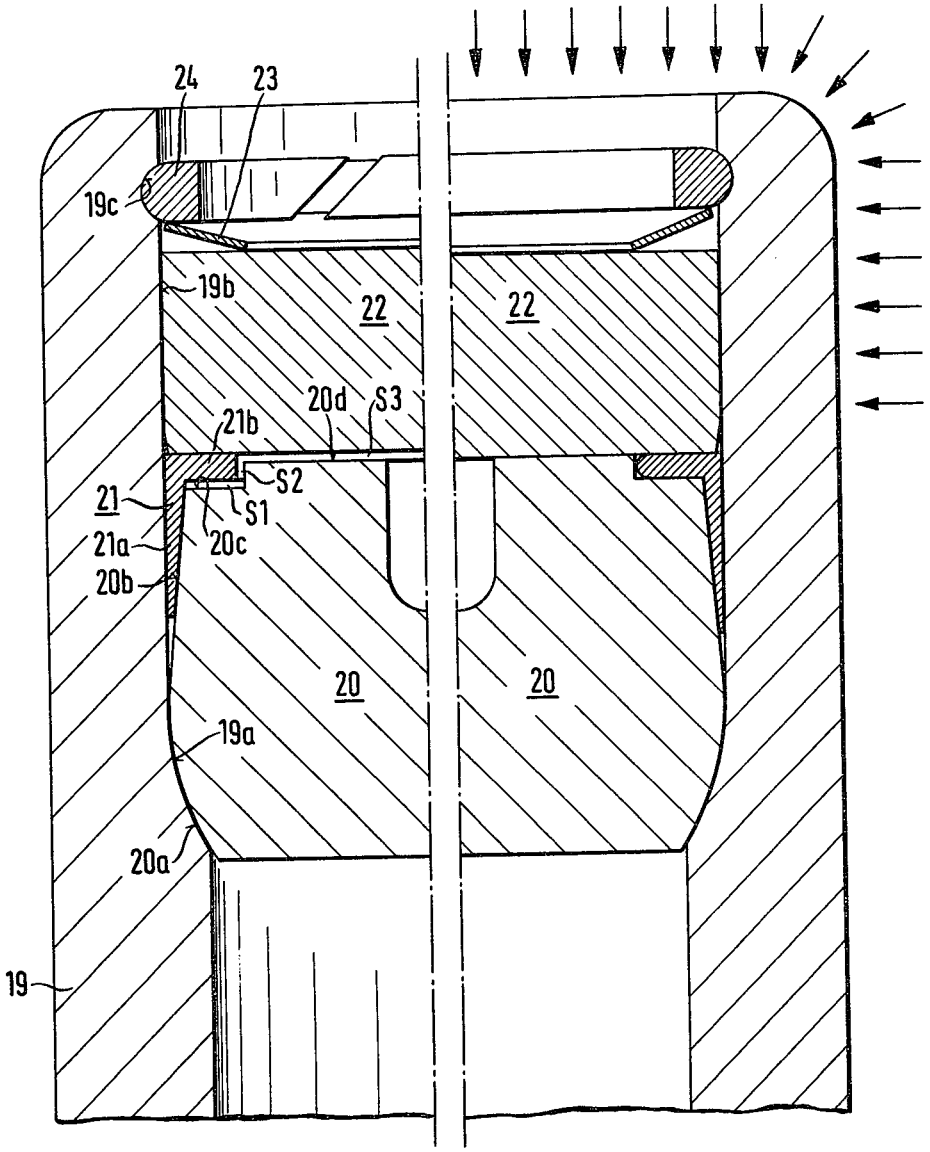
FIG. 3 shows a third embodiment with a sealing cover provided with a spherical seating area and a pressure cover acting upon the sealing cover by means of an annular seal.

In the embodiment according to FIG. 3, the container 19 is provided with a partly spherical sealing surface 19*a* in the region of its filling opening. A sealing cover 20 lies with its correspondingly shaped sealing surface 20*a* on the sealing surface 19*a*. A straight cylindrical surface 19*b* connects with the sealing surface 19*a*. As in the embodiment according to FIG. 2, the sealing cover 20 is provided with a conical sealing surface 20*b* extending inwardly and lying opposite the surface 19*b*, and with a flanged step 20*c* connecting with the sealing surface. An annular seal 21 with a wedge-shaped section 21*a* and an annular section 21*b* is inserted into the gap between the conical sealing surface 20*b* and the flanged step 20*c*. The dimensions of this annular seal in relation to the wedge-shaped gap and the flanged step are such that, when the annular seal is being prestressed, it overlaps the free front surface 20*d* and leaves a predetermined space against both surfaces of the flanged step 20*c*.

On the free upper side of the annular section 21*b*, there is a pressure cover 22, the dimensions of which are such that it can be moved along the wall 19*b* in a similar way to a piston, in the axial direction. (In the foregoing, and until further notice, only the left half of FIG. 3 is being considered). A spring element 23 engages with the free upper side of the pressure cover 22, this spring element for its part being held by a clamping ring 24. The clamping ring engages with an annular slot 19*c* provided in the annular surface 19*b* in the region of the free opening of the container 19.

After the container 19 for final storage has been filled with radioactive substances, the cover 20 is put in position. Then the annular seal 21 is inserted and compressed with a punch until it forms a uniform seal against the surfaces 19*a* and 20*a*. The dimensions of the annular seal 21 are such that a gap S1 remains below the annular section 21*b* and a gap S2 remains between the inner surface of the annular section 21*b* and the vertical surface of the flanged step 20*c*, and the annular section 21*c* has a projecting length S3 over the free front surface 20*c* of the sealing cover 20. The pressure cover 22 is then inserted until it comes into contact with the upper side of the annular section 21*b* of the sealing element and forms the gap S3 corresponding to the projecting length. Subsequently, the spring element 23 is positioned and compressed by use of the slotted clamping ring 24, so that the desired axial initial stressing force is obtained. The left half of FIG. 3 shows the container in a prestressed condition after being loaded.

If, after storage of the final storage container in a salt mine, there occurs a uniform external compressive load on the container due to salt convergence, as is shown by the arrows on the right-hand side of FIG. 3, then a force corresponding to that produced by the external pressure on the free pressure cover surface is exerted on the pressure cover 22, this force being transmitted to the upper side of the annular section 21*b* of the annular seal 21. In contrast to the embodiment according to FIG. 2, in the embodiment according to FIG. 3 the annular seal 21 should be composed of a material which is not only preferably highly corrosion-resistant but which is also ductile. Because of this property, the annular seal begins to deform at a certain axial force produced by the cover 22, that is at a defined contact pressure between the sealing surfaces 19*a* and 20*a*, and passes into the annular gaps S1 and S2 between the annular seal 21 and the sealing cover 20. By this means, the dimensions of the annular clearances in question are such that, after the pressure cover 22 has been placed on the sealing cover 20 (after removal of the projecting length S3) the gaps S1 and S2 are filled with the material from the annular seal 21. After the pressure cover 22 has been placed on the sealing cover 2, the deforming process of the ductile sealing material is concluded, and the axial forces are transmitted to the sealing surfaces 19*a* 20*a*, so that the sealing action on these sealing surfaces is increased. Hereby, however, the sealing element exerts a force corresponding to its deformation and thus exerts a sealing action on the sealing surfaces of the sealing cover and container wall.

Instead of the prefabricated seals 18 and 21, an adhesive can also be used, In particular a ceramic adhesive, as is described below.

Figure 5:
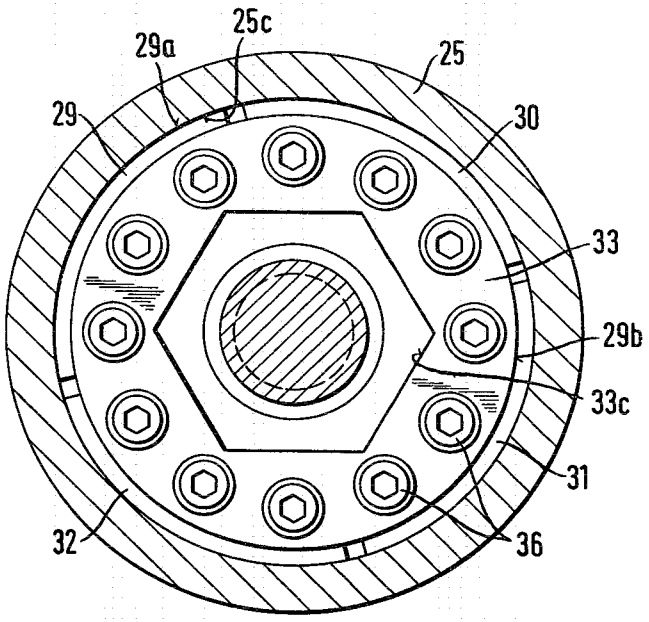
FIGS. 4 and 5 show a further embodiment with a spherical sealing cover, a prestressing device and a special protective cover.
Figure 4:
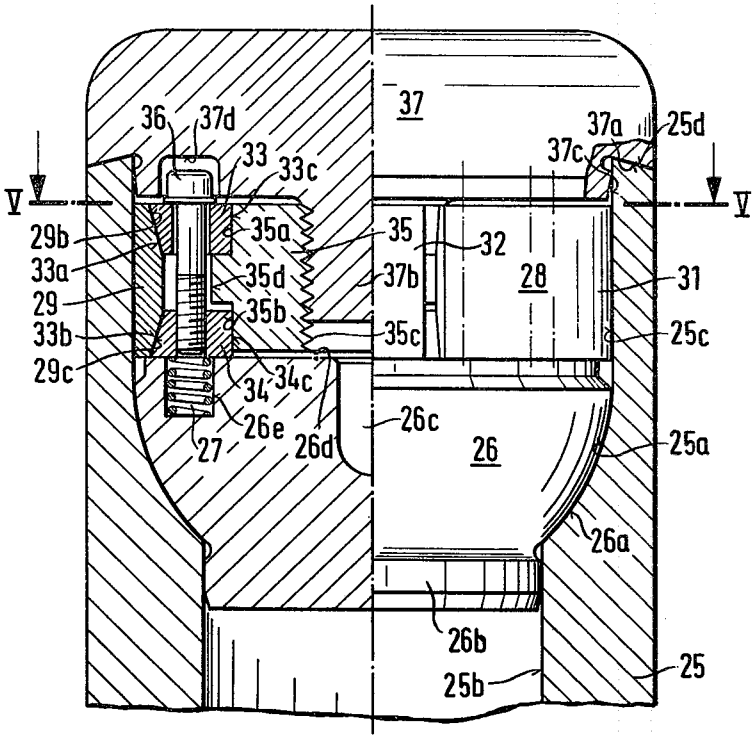

In the embodiment according to FIGS. 4 and 5, the container 25 is provided with a curved sealing surface 25*a*, with which engages a corresponding sealing surface 26*a* of a sealing cover 26. On its lower side, the sealing cover 26 is provided with a cylindrical projection 26*b* which, with an eccentric axial loading of the sealing cover 26, is supported on the straight cylindrical container wall 25*b* downwardly connecting with the sealing surface 25*a*, and can thereby prevent any tilting of the sealing cover 26. As in the embodiment according to FIGS. 1 and 3, a manipulation opening 26*c* is provided. Several blind holes 26*e* are distributed uniformly on the upper free front surface 26*d*, pressure springs 27 being arranged in these blind holes.

Above the sealing cover 26 there is a tensioning element 28. This has four external clamping plates 29, 30, 31 and 32 which are in the shape of a circular sector, and which are described in further detail with reference to clamping plate 29. The clamping plate 29 lies with its straight cylinderical outer wall 29*a* abutting a surface 25*c* which outwardly connects with the sealing surface 25*a*. The inner surface of the clamping plate 29 has two conical clamping surfaces 29*b* and 29*c* sloping in opposite directions.

A clamping ring 33 cooperates with the clamping surface 29*b* and a clamping ring 34 with the clamping surface 29*c*. Both clamping rings have on their circumference conical clamping surfaces 33*a* and 33*b* respectively which slope in the opposite direction to the clamping surfaces of the clamping plates. The internal surfaces of the clamping rings 33 and 34 are in the form of hexagonal surfaces 33*c* and 34*c* extending axially, which are in contact with the corresponding surfaces 35*a* and 35*b* of a sleeve-like abutment 35, the central opening of which is provided with an internal thread 35*c*. A circular flange 35*d* projects between the hexagonal surfaces 35*a* and 35*b*, the upper clamping ring 33 resting on this flange.

The clamping rings 33 and 34 are provided with uniformly distributed boreholes, whereby the boreholes on the lower clamping ring 34 are provided with internal threads. Through the borehole in the upper clamping ring 33, bolts 36 engage with the threaded holes in the lower clamping ring.

The front surface 25*d* of the container 25, connecting with the surface 25*c* slopes outwardly. On this surface there is a guard 37 having a sealing surface 37*a* which has a slope corresponding to the surface 25*d*, this guard engaging with the borehole 35*c* of the abutment 35 by means of a threaded pin 37*b*. The guard engages with the opening of the container 25 by means of a projection 37*c*, and has recesses 37*d* into which the heads of the bolts 36 can extend when the guard is closed. The surfaces 25*d* and 37*a*, which are in sealed contact with each other, are also lapped.

After the final storage container 25 has been filled, the cover 26 is inserted into the container by guiding its cylindrical projection 26*b*. Compression springs 27 are then inserted, or have already been inserted, into the blind holes 26*e*, these compression springs projecting from the free surface 26*d* of the cover 26 by a predetermined amount when their compression is released. Then the tensioning element 28 is fed in the direction of the sealing cover 26 without final stress being applied to the clamping rings, until the desired compression has been applied to the compression springs 27 and the clamping ring 34 and clamping plates 29–32 rest on the front surface 26*d*. By screwing down the clamping bolts 36, the clamping rings 33 and 34 are tensioned on each other, which is made possible particularly by the clearance between the lug 37*d* and the lower clamping ring 34, so that the clamping plates 29–32 are tensioned radially outwards. Thus, the tensioning element 28 is fixed in its position and axial forces can be transferred to the container wall 25*c* by frictional contact. It should be pointed out that the prestressing device does not have to be lowered until the clamping ring 34 is in contact with the upper side, if the desired prestressing force has already been obtained by compression of the spring 27. In place of the tensioning element 28 described above, the friction sleeves according to pending German patent application No. P 3048380 can also be used.

The sealing cover 26 is pressed into its seating by the prestressing device with an adjustable force which is dependent on the spring constants of the compression springs used, and a minimum contact pressure is exerted which guarantees a sealing action. Naturally, other spring elements than coil compression springs can also be used.

Subsequently, the guard is screwed into place by means of the threaded pin 37, until its sealing surface 37*a* rests on the sealing surface 25*d*.

The sealing action between the surfaces 25*d* and 37*a* is increased by the underground pressure. The surfaces 35*d* and 37*a* do not necessarily have to be sloping in the manner shown in FIG. 4, it is also possible, for example, for the surfaces to extend radially.

If the guard should be destroyed by long-term corrosion, or if it should lose its sealing effect, then the salt which is viscous under pressure can penetrate into the upper area of the container and directly load the sealing cover 26 and thereby increase its sealing action.

In the embodiment according to FIG. 6, a cap-like cover 38 is attached to the container 60. In the contact areas 60*a* and 38*a*, the containers are suitably ground so as to obtain a polished finish, that is, lapped. The contact areas are firstly coarsely ground and then polished so as to achieve the desired properties of the surfaces which go to make up the contact forming the prestressing, which is presumably derived from attersion forces.

If it is necessary to guarantee this contact, a cylindrical locking element 39 is arranged, as is shown in FIG. 6, in such a way that it engages both with the filling opening of the container 60 and also with the interior of the cap-like cover 38. It is secured in this position by means of an adhesive, preferably a ceramic adhesive, as is shown by the layer of adhesive 40 in FIG. 6. Additionally or alternatively, it is possible to place an adjustment cap 41 above the cover 38, the apron 41*a* of which overlaps the container 60 and is secured thereto also by means of a ceramic adhesive 42. The components 39 and 41 can also be used as a safety device—depending on requirements.

Whilst, in the embodiments so far described, the filling opening has a cross-section essentially corresponding to the cross-section of the receiving area of the container, and the wall thickness of the container is reduced in its area of contact with the cover, it is also possible to provide the container with a filling opening with a smaller cross-section. It is thereby achieved that, on the one hand, a reduction in wall thickness is not necessary, and on the other hand a cover of smaller dimensions can be used.

In the embodiment according to FIG. 7, the container 43 has a bottle-like configuration with a bottle neck 43*a* which is connected with the container 43 via a shoulder 43*b* and which defines a filling opening 43*c*. A stopper 44 with a corresponding conical configuration is inserted into the neck 43*a* and is held there by a spindle 45 which is connected to it or formed so as to be in one piece with it, this spindle engaging as a tie rod with an abutment 46 supported on the shoulder 43*b*. The abutment 46 is held in the area of the opening by holding lugs 46*a*, and has contact surfaces 46*b* corresponding to the shoulder 43*b*.

Embodiments covering methods of fixing can also be considered in which the cover is secured by a snap contact with a correspondingly formed abutment.

A cap can be placed above the stopper 44, which then together with the stopper forms a labyrinth seal. Laminated materials can obviously also be used here, for example, a ceramic adhesive.

In the embodiment shown in FIG. 8, the neck 47*a* has a circular cylindrical configuration. The cover 48 is provided with a flange 48*a* which lies with its contact surface 48*b* on the free front surface 47*d* of the neck. The prestressing device attached to the filling opening 47*c* corresponds to that shown in FIG. 7, whereby the abutment is pressed against the shoulder 47*b*.

In the embodiment according to FIG. 9, two covers are in contact with the neck 49*a* of a container 49, a conical cover 44 (see FIG. 7) and a cover 50 which, as with the cover 48, is in contact with the free front surface 49*d* of the neck. The cover 50 is held onto the container by a collar 51 with flanges 51*a* and 51*b*, whereby the flange 51*a* grips the cover 50 and the flange 51*b* grips round an edge 49*b* of the neck 49*a*. In place of a flanged ring, a clamping ring can also be used.

In the embodiment according to FIGS. 7–9, small covers are used which results in easier handling, due to the smaller sealing surfaces, and greater sealing. Closure with tapered covers is possible, without the wall thickness in the area of the cover having to be reduced in comparison to the wall thickness in the receiving area of the container, that is, reductions in rigidity and possible interference stresses in the material of the container are avoided.

Should the tools being used make it necessary, the pressure cover 4, sealing cover 7, pressure cover 22, pressure cover 37 and covers 44, 48 and 50 can be provided with special attachment surfaces and/or openings.

If necessary, both a pulling and a compressing prestressing device can simultaneously be applied to a cover, that is, the compressing prestressing devices according to FIGS. 1 and 3 can be combined, for example, with the pulling prestressing devices according to FIGS. 2 and 7.

In the embodiment according to FIG. 4, the compression springs 27 and the tensioning element 28 form th prestressing device, whilst in the embodiment according to FIG. 6 the prestressing is obtained by the special treatment of the surfaces.

In the claims and in the preceding description, the phrase "ceramic material" refers to an inorganic, nonmetallic material which will not easily dissolve in water and which is at least 30% crystalline. Usually ceramic components are formed from the raw material at room temperature and obtain their typical properties by treatment at a temperature of ≧800° C. (see Electrotechnical Journal, Issue A, Bd. 91–1970-, page 489, 2nd para).

Ceramic adhesives, such as those sold by the company Aremco Products, are particularly suitable as sufficiently heat and corrosion-proof adhesives and sealing agents which can be subjected to radioactive radiation. Such adhesives are available based on aluminium oxide, zirconium oxide, magnesium oxide and, with regard to their adhesive properties, can be used on ceramics, graphite, quartz, bornitride, silicon oxide and metals such as steel, aluminium and copper, that is, they can be used for forming a connection and/or sealing between a cover, container, locking element and prestressing device consisting of metal and/or ceramic material.

We claim:

1. A method for closing with a cover a container for the final storage of radioactive substances, wherein at least one of the container and cover consists of a material selected from ceramic and metallic material, and wherein the container and cover are suitably ground in their seating areas which cooperate with each other, and when the container is closed the cover is held by prestressing on the seating area of the container.

2. A method according to claim 1, wherein the cover is pressed against the seating area of the container from the outside.

3. A method according to claim 1, wherein the cover is pulled against the seating area of the container from the inside.

4. A method according to claim 1, wherein, after grinding, a thin equalising layer of highly corrosion-resistant, deformable material is applied to at least one of the seating areas of the container and cover.

5. A method according to claim 4, wherein a prefabricated foil is applied as the layer.

6. A method according to claim 4, wherein the layer is mounted on the seating area.

7. A method according to claim 4, wherein a ductile metal is used as the material for the layer.

8. A method according to claim 4, wherein a deformable ceramic is applied as the material for the layer.

9. A method according to claim 1, wherein the prestressing force is resilient.

10. A method according to claim 1, wherein the container and cover are lapped on their seating areas in such a way that the prestressing is effected by the forces acting between the lapped surfaces.

11. A method according to claim 1, wherein outside the seating area of the cover a further seal is formed between the cover and the container.

12. A storage device consisting of a container for the final storage of radioactive substances and a cover for the container, wherein one of the container and cover consists of a material selected from ceramic and metallic material, and wherein the container and cover are suitably ground on their seating areas which cooperate with each other, and a prestressing device is provided which is supported on the container and engages the cover, this prestressing device prestressing the cover against the seating area of the container.

13. A storage device according to claim 12, wherein the prestressing device is supported on the container in a form-locking manner.

14. A storage device according to claim 12, wherein the prestressing device is supported tensionally on the container.

15. A storage device according to claim 12, wherein the prestressing device is a pressure device engaging with the cover from the outside which can transfer underground pressure to the cover.

16. A storage device according to claim 12, wherein the prestressing device is a tensioning device engaging with the cover from the inside.

17. A storage device according to claim 12, wherein the prestressing device has at least one flexible element inserted between the cover and the container.

18. A storage device according to claim 12, wherein an equalising layer is provided between the seating areas of the container and cover which engage with each other.

19. A storage device according to claim 12, wherein in a gap between the inner wall of the container and the outer wall of the cover, an annular seal is provided which can be acted upon from the outside.

20. A storage device according to claim 12, wherein in a gap between the inner wall of the container and the outer wall of the cover, a sealing agent is provided which can be acted upon from the outside.

21. A storage device according to claim 19, wherein the annular seal is arranged between a pressure cover, passing on the initial stress in the direction of the sealing cover, and the sealing cover in such a way that the annular seal transfers the initial stress to the sealing cover and, under action of underground pressure, this annular seal can be deformed until the pressure cover is in contact with the sealing cover.

22. A storage device according to claim 19, wherein the annular seal has a wedge-shaped section lying on the outside and extending in the direction of the axis of the container, and an annular section extending at right angles to the container.

23. A storage device according to claim 12, wherein a buffer layer is arranged between the prestressing device and the cover.

24. A storage device consisting of a container for the final storage of radioactive substances and a cover for the container, wherein at least one of the container and cover consists of a material selected from ceramic and metallic material, the container and cover are suitably lapped on their seating areas which cooperate with each other in such a way that the cover is prestressed against the seating area of the container by the forces acting between the lapped surfaces.

25. A storage device according to claim 24, wherein a locking element is added to the container and cover, which prevents relative displacement along the seating areas.

26. A storage device according to claim 25, wherein the locking element is fixed to one of the container and cover by means of a ceramic adhesive.

27. A storage device according to claim 12, wherein the seating areas are rotational surfaces selected from straight circular surfaces connected with each other, conical surfaces and partly spherical surfaces.

28. A storage device according to claim 12, wherein the cross-section of the feed opening is smaller than the cross-section of the receiving opening of the container.

29. A storage device according to claim 12, wherein the receiving opening is surrounded by a collar.

* * * * *